US005149280A

United States Patent [19]

Edgley et al.

[11] Patent Number: 5,149,280

[45] Date of Patent: Sep. 22, 1992

[54] WIRE HOLDING DEVICE FOR DISCRETE ELECTRICAL WIRES

[75] Inventors: Richard R. Edgley, Elmhurst; Peter Ingwersen, Gilberts; Dennis W. Berek, Naperville, all of Ill.

[73] Assignee: Molex Incorporated, Lisle, Ill.

[21] Appl. No.: 773,466

[22] Filed: Oct. 9, 1991

[51] Int. Cl.[5] ..... H01R 13/58

[52] U.S. Cl. ..... 439/457; 439/456

[58] Field of Search ..... 439/456, 457, 458, 459

[56] References Cited

U.S. PATENT DOCUMENTS

| | | | |
|---|---|---|---|
| 3,541,229 | 11/1970 | De Smidt | 439/459 X |
| 3,871,072 | 3/1975 | Folk | 29/628 |
| 4,093,334 | 6/1978 | Wickenberg et al. | 339/107 |
| 4,267,542 | 5/1981 | Weiner | 439/457 X |
| 4,586,776 | 5/1986 | Ollis et al. | 339/105 |
| 4,797,112 | 1/1989 | Weisenburger | 439/55 |
| 4,860,801 | 8/1989 | Nicholas et al. | 140/105 |

*Primary Examiner*—Eugene F. Desmond
*Attorney, Agent, or Firm*—Stephen Z. Weiss

[57] ABSTRACT

A wire holding device is disclosed for holding a plurality of discrete electrical wires in a side-by-side relationship and to facilitate providing longitudinal strain relief for the wires. The device includes a housing, and a plurality of generally parallel retaining passages through the housing for axially receiving and substantially surrounding the wires to retain the wires in substantially all radial directions. A plurality of access windows extend through the housing transversely of the retaining passages to provide access to the wires in the passages by an appropriate bending tool. Each retaining passage has a cavity opposite each respective window and into which a portion of a respective wire can be bent laterally of its axis so that the bent portion of the wire provides longitudinal strain relief for the wire.

8 Claims, 2 Drawing Sheets

WIRE HOLDING DEVICE FOR DISCRETE ELECTRICAL WIRES

FIELD OF THE INVENTION

This invention relates to a wire holding device for holding a plurality of discrete electrical wires in a side-by-side relationship.

BACKGROUND OF THE INVENTION

Electrical wires, harnesses and the like are manufactured in a variety of configurations, including electrical cables having a plurality of discrete wires and flat electrical cables commonly called ribbon cables. Cables of discrete wires simply include a plurality of discrete conductors each surrounded by an insulating sheath or cladding. Ribbon cables include a plurality of conductors in a side-by-side parallel array joined by a flat ribbon or web of insulating material.

Flat ribbon cables have various advantages, versus discrete wire cables, such as "gang" loading of the conductors into connectors as well as easy simultaneous termination of the conductors. In addition, the conductors in a flat ribbon cable have precise predetermined positions relative to each other lengthwise of the cable. The conductors of ribbon cables are much easier to manipulate, handle and terminate while in a constant predetermined array.

On the other hand, flat ribbon cables have various disadvantages, particularly in the cost of such cables compared to discrete wire cables. It is difficult to form branches in a harness from a flat ribbon cable. Conductors of different sizes or wire gauges are not commonly found in flat ribbon cables.

Because of the various disadvantages of flat ribbon cables, it has become desirable to provide wire holding devices which hold a plurality of discrete electrical wires in a side-by-side parallel relationship and, thereby, provide some of the advantages of a flat ribbon cable without the disadvantages thereof. Heretofore, most such wire holding devices are loaded with discrete wires in a direction generally transversely of the axes of the wires. Various latching arrangements are provided to hold the transversely loaded wires in the holding devices, against dislodgment of the wires longitudinally of their axes. Such wire holding devices often are relatively expensive or, if not expensive, rather difficult to manufacture, such as by molding processes. This invention is directed to providing an extremely simple wire holding device of the character described.

SUMMARY OF THE INVENTION

An object, therefor, of the invention is to provide a new and improved wire holding device for holding a plurality of discrete electrical wires in a side-by-side relationship and to facilitate providing longitudinal strain relief for the wires.

In the exemplary embodiment of the invention, the wire holding device includes a housing having a plurality of generally parallel retaining passages therethrough for longitudinally receiving and substantially surrounding the wires to retain the wires in substantially all radial directions. A plurality of access windows extend through the housing transversely of the retaining passages to provide access to the wires in the passages by an appropriate bending tool. Each retaining passage has cavity means opposite each respective window and into which a portion of a respective wire can be bent laterally of its axis so that the bent portion of the wire provides longitudinal and radial strain relief for the wire.

In the preferred embodiment of the invention, the windows and the cavity means are provided by second passages extending through the housing transverse to and intersecting the retaining passages.

The housing has a body portion through which the retaining passages extend, whereby the passages have wire-insertion ends and wire-exiting ends. The housing includes a wire guard portion projecting from the body portion at the wire-exiting ends of the passages to protect distal ends of the wires projecting from the wire-exiting ends of the passages. The wire guard portion of the housing surrounds less than all sides of the distal ends of the wires, and the wire guard portion is connected to the body portion by frangible means. The wire guard portion of the housing can be broken off of the body portion of the housing simply by bending movement of the frangible means. For instance, the housing may be unitarily formed of dielectric material, and the frangible means may comprise weakened portions of the dielectric material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 4:
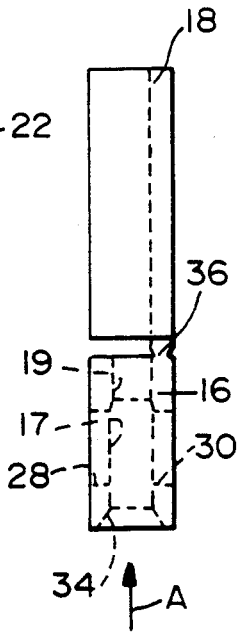
FIG. 4 is a side elevational view of the device.
Figure 5:
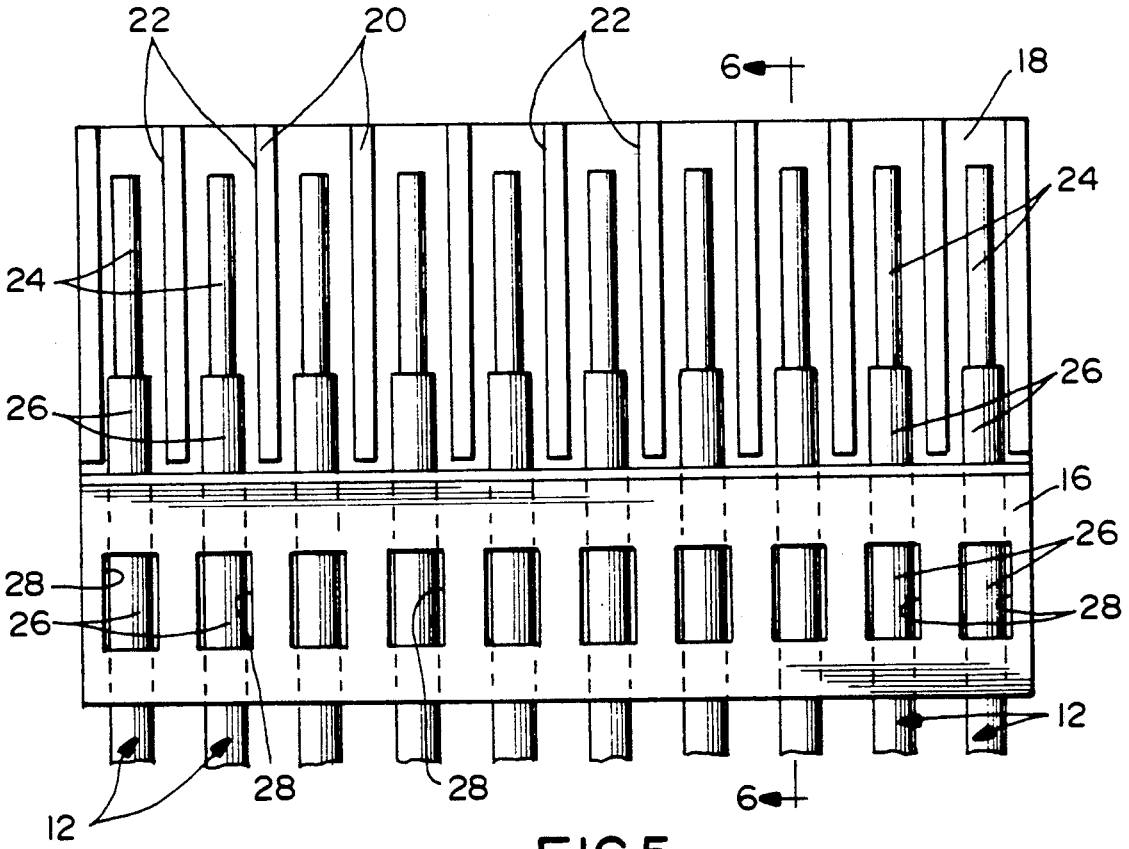
FIG. 5 is a top plan view of the device as in FIG. 1, but on an enlarged scale and with a plurality of discrete electrical wires inserted thereinto.

Referring to the drawings in greater detail, and first to FIGS. 1–4, the invention is embodied in a wire holding device, generally designated 10, for holding a plurality of discrete electrical wires, generally designated 12 (FIG. 5). The device is a unitary structure of simple construction integrally molded of dielectric material such as plastic or the like.

In essence, unitary wire holding device, generally designated 10, is molded in the form of a housing, which includes a body portion 16 and a wire guard portion 18. Body portion 16 has a plurality of generally parallel retaining passages 17 and 19 extending therethrough for longitudinally receiving and substantially surrounding discrete electrical wires 12 to retain the wires in substantially all radial directions. Retaining passage 17 is rectangular in cross section and retaining passage 19 is circular in cross section. Once the wires are inserted into passages 17 and 19 in the direction of arrow "A" (FIG. 4), the through passages 17 and 19 in body portion 16 surround the wires and prevent the wires from moving transversely of their axes. No additional latching means whatsoever are necessary to hold the wires laterally in the passages, as is prevalent with the prior art wherein the wires are loaded into various wire holding devices transversely of the axes of the wires.

Wire guard portion 18 is provided in the form of a platform having a plurality of partitions 20 dividing the wire-exiting end of the device into a plurality of troughs 22. While the wires are radially contained within passages 19, the wires rest on the wire guard portion and are protected by partitions 20. Each wire 12 includes a conductor 24 surrounded by an insulating sheath or cladding 26 (see FIG. 5). The delicate exposed conductors are protected between partitions 20.

Figure 3:
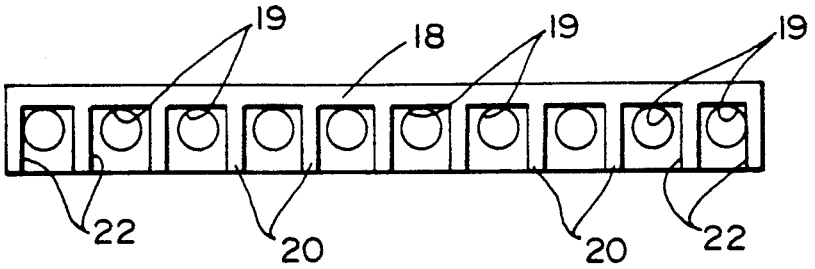
FIG. 3 is an elevational view of the rear or wire-exiting end of the device.
Figure 1:
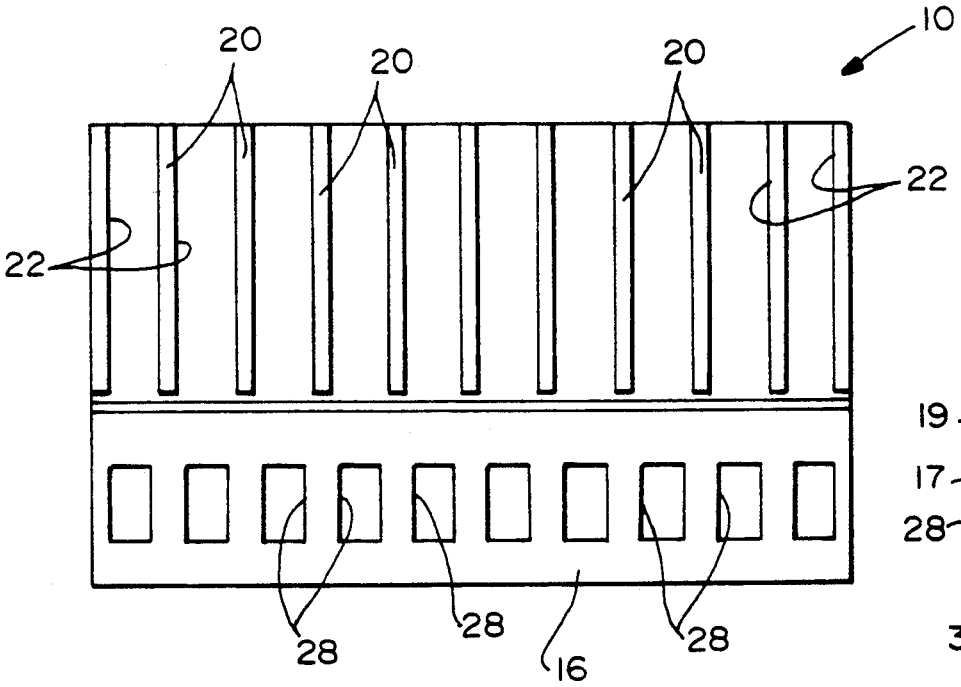
FIG. 1 is a top plan view of the wire holding device of the invention.
Figure 6:
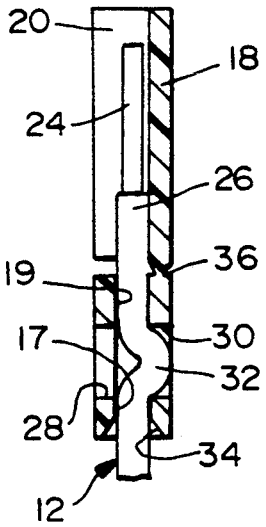
FIG. 6 is a vertical section taken generally along line 6—6 of FIG. 5, through one of the retaining passages and with a discrete electrical wire located in the passage and bent to provide strain relief therefor.

Referring to FIG. 6 in conjunction with FIGS. 1, 4 and 5, a plurality of access windows 28 extend through body portion 16 transversely of retaining passages 17 to provide access to the wires in the passages 17 by an appropriate bending tool (not shown). Each passage 17 also has a cavity 30 opposite each respective window 28 and into which a portion 32 of a respective wire can be bent laterally of its axis, so that the bent portion 32 of the wire provides rotational and longitudinal strain relief for the wire, as clearly shown in FIG. 6.

According to the scheme of providing a very simple, unitarily molded holding device 10, windows 28 and cavities 30 are provided simply by a second passage extending through body portion 16 of the housing transverse to and intersecting retaining passages 19.

Figure 2:
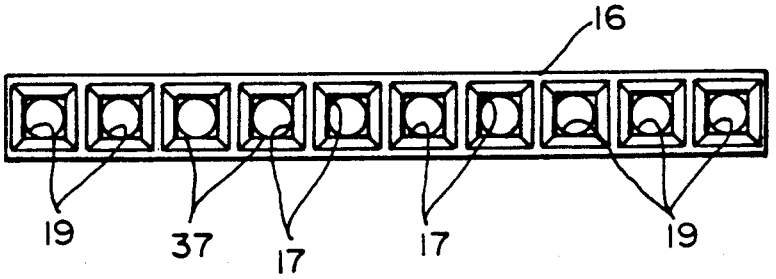
FIG. 2 is an elevational view of the front or wire-insertion end of the device.

FIG. 6, in conjunction with FIG. 2, also shows that tapered mouths 34 are provided at the wire-insertion ends of passages 19 to facilitate guiding the stripped conductor portions 24 of the wires into the passages, as indicated by arrow "A".

Figure 7:
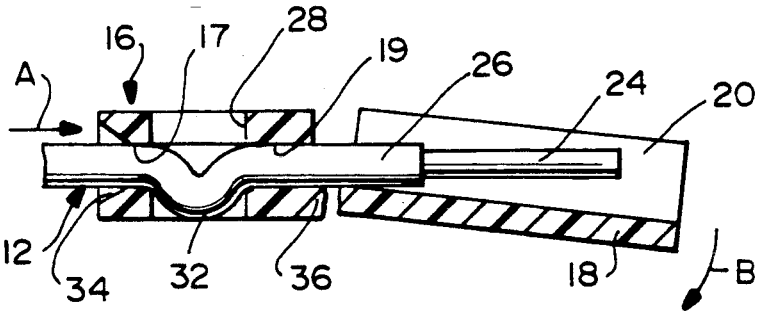
FIG. 7 is a view similar to that of FIG. 6, with the wire guard portion being broken away from the body portion of the device.

Referring to FIG. 7, means are provided for removing wire guard portion 18 of the device after the wires are inserted into the device and are bent to provide strain relief therefor. With the entire device unitarily molded of dielectric material, such as plastic or the like, means are provided for simply breaking the wire guard portion 18 off of body portion 16.

More particularly, whereas FIG. 6 shows a weakened area 36 molded integrally with the device between wire guard portion 18 and housing portion 16, FIG. 7 shows the wire guard portion being broken away from the body portion by forces directed on the wire guard portion in the direction of arrow "B". With the wire guard portion removed, the wires now are retained radially, rotationally about its longitudinal axis and longitudinally all within body portion 16 which, in turn, holds all of the wires in a generally parallel side-by-side relationship. The exposed conductors of the wires now can be gang loaded into an appropriate electrical connector, can be mass terminated or can be used in their parallel array for other manufacturing, assembly or like operations.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

We claim:

1. In a wire holding device for holding a plurality of discrete electrical wires in a generally parallel side-by-side relationship and to facilitate providing longitudinal strain relief therefor, the improvement comprising:

a housing, a plurality of generally parallel retaining passages through the housing for longitudinally receiving and substantially surrounding the wires to retain the wires in substantially all radial lateral directions, a plurality of access windows extending through the housing transversely of the retaining passages to provide access to the wires in the passages by an appropriate bending tool, each retaining passage having cavity means opposite each respective window and into which a portion of a respective wire can be bent laterally of its axis so that the bent portion of the wire provides rotational and longitudinal strain relief for the wire, said windows and said cavity means being provided by second passages extending through the housing transverse to and intersecting the retaining passages, and said housing having a body portion through which the retaining passages extend, the passages having wire-insertion ends and wire-exiting ends, and the housing including a wire guard portion projecting from the body portion at the wire-exiting ends of the passages to protect distal ends of the wires projecting from the wire-exiting ends of the passages, the wire guard portion of the housing surrounding less than all sides of the distal ends of the wires.

2. In a wire holding device as set forth in claim 1, wherein said wire guard portion is connected to the body portion by frangible means.

3. In a wire holding device as set forth in claim 2, wherein said housing, including the body portion and the wire guard portion thereof, is unitarily formed of dielectric material.

4. In a wire holding device as set forth in claim 3, wherein frangible means comprise a weakened portion of the dielectric material of the housing.

5. In a wire holding device for holding an electrical wire and to facilitate providing strain relief therefor, the improvement comprising:

a housing, a retaining passage extending through the housing for longitudinally receiving and substantially surrounding the wire to retain the wire in substantially all radial directions, an access window extending through the housing transversely of the retaining passage to provide access to the wire in the passage by an appropriate bending tool, the retaining passage having a cavity opposite the window and into which a portion of the wire can be bent laterally of its axis so that the bent portion of the wire provides rotational and longitudinal strain relief for the wire, said window and said cavity being provided by a second passage extending through the housing transverse to and intersecting the retaining passage, and said housing having a body portion through which the retaining passage extends, the passage having a wire-insertion end and a wire-exiting end, and the housing including a wire guard portion projecting from the body portion at the wire-exiting end of the passage to protect a distal end of the wire projecting from the wire-exiting end of the passage, the wire guard portion of the housing surrounding less than all sides of the distal end of the wire.

6. In a wire holding device as set forth in claim 5, wherein said wire guard portion is connected to the body portion by frangible means.

7. In a wire holding device as set forth in claim 6, wherein said housing, including the body portion and the wire guard portion thereof, is unitarily formed of dielectric material.

8. In a wire holding device as set forth in claim 7, wherein frangible means comprise a weakened portion of the dielectric material of the housing.

* * * * *